United States Patent [19]

Cousins

[11] 4,235,240

[45] Nov. 25, 1980

[54] UNDERGARMENT REINFORCEMENTS

[75] Inventor: Sydne Cousins, New York, N.Y.

[73] Assignee: Bonnie Enterprises, Inc., Cranford, N.J.

[21] Appl. No.: 935,299

[22] Filed: Aug. 21, 1978

[51] Int. Cl.[2] ..... A41C 1/14

[52] U.S. Cl. ..... 128/476

[58] Field of Search ..... 2/257, 256; 128/465, 128/476

[56] References Cited

U.S. PATENT DOCUMENTS

| | | | |
|---|---|---|---|
| 1,474,190 | 11/1923 | Fox | 2/256 |
| 3,030,633 | 4/1962 | Chalfin | 2/258 |
| 3,035,584 | 5/1962 | Menkel | 128/476 |
| 3,531,807 | 10/1970 | Devito | 2/256 |
| 3,562,802 | 2/1971 | Avis | 128/476 |

*Primary Examiner*—Werner H. Schroeder
*Assistant Examiner*—Doris L. Troutman

[57] ABSTRACT

A stiffening structure for use in a woman's brassiere to replace bones or wires, which features a main support member and a flange appended thereto. The flange includes either bifurcations or notches at desired locations to render flexibility to the structure, with the support member itself providing rigidity in order to accomplish the supporting function of the stiffening structure. In the preferred embodiment, the stiffening structure material is rigid and yet subject to easy perforation by a sewing needle in order to sew the structure in place in the undergarment so that it remains motionless in the brassiere. It is also possible to have a series of pre-cut sewing holes in the flange to ease the sewing operation. As a further alternative, the flange could be bonded directly to the material. As a still further alternative, the main support member is tapered three dimensionally—thicker at the center and thinner at the periphery and ends for increased flexibility.

7 Claims, 12 Drawing Figures

UNDERGARMENT REINFORCEMENTS

This invention relates primarily to undergarments and more particularly to stiffening materials and structures for controlling each cup of a brassiere.

Stiffening materials for reinforcing women's undergarments, particularly brassieres, relates to a field that has undergone significant fashion changes in recent years. Bras began with the attempt to simulate a natural look and feel, it being important to provide an appearance that the woman's breasts were uncovered except for the outer garment. This progression continued to where the natural, supported look became more and more acceptable. From this stage, the braless phase overcame both women and men in this country. The present state of the art seems to be moving back to the use of bras, but with a combination of support features and a natural look, thus combining the first two phases through which the industry moved at its earliest stages.

Many attempts have been made to provide supporting materials in bras to provide primarily not only a lifting but also a controlled spreading support. In most cases, the supporting materials used (wire or bone, or both) were and are not comfortable, were apparent through outer garments, and did not satisfactorily present a natural appearance. Considering that the bra material itself has progressed to the present seamless structure, the protrusion of bone materials (metal or plastic) results in a particularly unnatural look with the lowermost outline of the bra being apparent through outer garments.

Another major problem in the prior art is that the use of wires or bones made of possible allergic materials could result in physical skin reactions, not only on the breasts but on the sternum and chest box itself. In addition, on occasion the wires penetrate through the fabric and could puncture the breast or the sternum, causing actual physical damage to the body of the wearer.

Furthermore, because of the sharpness on many of the bone and wire structures, they tend to cut through the garments and also cause physical damage to either the breast or the skin overlying the sternum. Such structures may also tear the bra.

Yet another problem with the wires and bones is that they tend to distort the natural shape of a woman, presenting an awkward looking appearance, as well as being unhealthy.

Also, the wires and bones will tend to bend out of shape and distort while being handled. For example, when bras are washed in an automatic washing machine they may bend. Accordingly, they have to be hand-washed; they should not be put into an automatic washing machine or automatic dryer.

Another problem with current wires and bones is the excessive amount of inventory required, since manufacturers of these items have a different design for each specific bra model. Thus, if one bra manufacturer has three different styles of bra in an A-cup, he may require three different wire designs, one for each A-cup model. When this is multiplied by different bra manufacturers and different size cups, the inventory problem attendant to wires and bones becomes enormous.

Accordingly, a primary object of the present invention is to provide a bra structure having a supporting element which may be rendered motionless within the breast support and yet provide the necessary rigidity to accomplish its supporting function.

Still yet another primary object of the present invention is to provide a brassiere which will support the breasts naturally and in accordance with the natural contour of the wearer, thus presenting the appearance of a subtle support.

Still yet another object of the present invention is to provide an undergarment supporting structure, particularly for bras, bikinis, one-piece garments, halters and swimwear, which is resilient, flexible and yet of a shape and structure to provide healthy support for a woman's breast.

Still yet another object of the present invention is to provide a brassiere whose support structure is made of non-allergic material and which does not present a physical damage hazard either to the breast or the sternum.

Still yet a further object of the present invention is to provide a support structure for a bra support whose insertion and affixation to the bra support can be accomplished at substantially reduced labor costs, and also result in substantially reduced inventory costs.

Still another object of the present invention is to provide a stiffening means for a bra which is of a material to avoid unsightly protrusion and yet which may be readily perforated or fused for fixing the stiffening means in a position to avoid "wandering" and stays put as originally designed.

Yet another object of the present invention is to provide a supporting structure which will allow the undergarment to be machine washed and dried.

Still another object of the present invention is to provide a supporting structure which will drastically reduce inventory requirements.

These and other objects of the present invention are accomplished in a preferred and alternative embodiment of the present invention which features a main support member shaped to conform to the base portion of a woman's breast for insertion in a sleeve formed in the lower part of a bra. Appended to the main support member is a similarly shaped flange, of reduced cross section, in order to add rigidity to the overall structure. The material of the structure is nylon or plastic or any flexible material to perform the intended functions, and the material and thickness of the flange enable its functioning as a sewing flange, whereby it is readly perforatd with a common sewing needle. In one alternative embodiment, the flange portion of the structure is repeatedly bifurcated to add more flexibility to the structure and yet maintain its control.

In another alternative embodiment, a pair of oppositely extending flanges (from the main support member) are repeatedly, but alternatively bifurcated to maintain the rigidity of the structure while adding more flexibility.

In yet another alternative embodiment, a pair of flanges are used, but each flange is alternatively notched without bifurcating the flange to its base in order to provide the flexibility of the above embodiment, while likewise providing even more rigidity and support for the stiffening structure.

In all embodiments, the structure of the present invention caresses the breasts gently, giving a natural appearance, and assures maximum comfort with no possible damage to the breast. The present invention also provides particularly appropriate construction for swimwear.

The above brief description, as well as further objects features and advantages of the present invention will be more fully appreciated by reference to the following, detailed description of the preferred, but nonetheless illustrative, embodiment, when taken in conjunction with the accompanying drawings, wherein.

Figure 1:
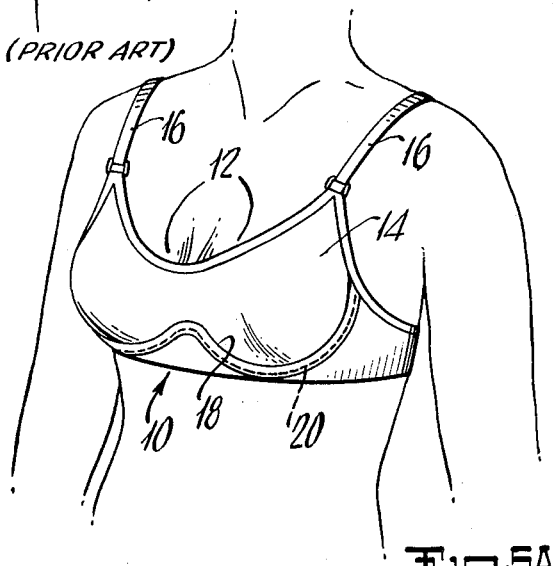
Fig. 1. (PRIOR ART)
FIG. 1 is a pictorial isometric view of the prior art showing a woman wearing a supportive bra.

Referring to the drawings, FIG. 1 illustrates a commonly available bra, generally designated 10 for use as a support for a woman's breat 12. The bra structure itself includes a main body 14 supported by straps 16 and defines at its bottom portion a sleeve 18 into which stiffening structure 20 is inserted. One common problem with bone material and sleeve 18 is that the bone material will "wander: and produce an undesirable appearance for the garment." Another problem is that the bone material, because of the quest for rigidity, will protrude, possibly causing pain to the wearer, as well as presenting an unsightly appearance, readily noticeable through outer garments. Furthermore, the feature of rigidity usually requires a structure which prevents the use of common sewing techniques for holding the stiffening structure 20 in place. Also, particularly considering today's active women, the stiffening structure 20 serves to produce extreme discomfort, even pain, as well as unsightly appearance during strenuous motion by the wearer. The lack of resiliency in most presently available construction materials leads easily to distortion of the wearer's garments.

Figure 2:
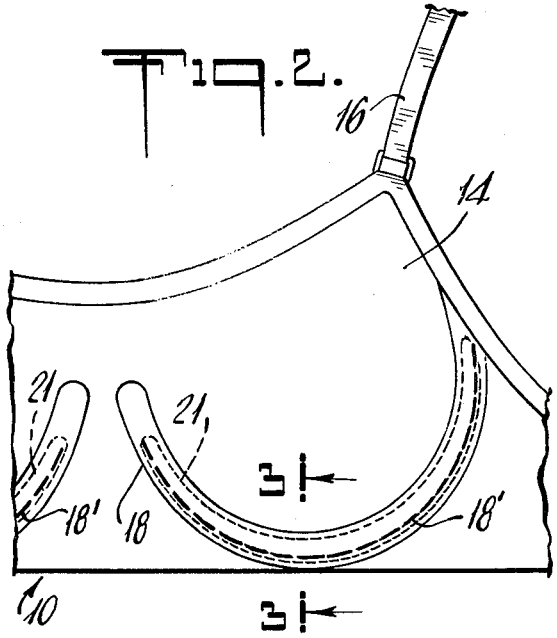
FIG. 2 is a partial front view of a bra structure according to the present invention.
Figure 5A:
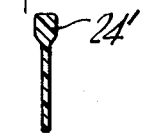
FIG. 5A is a view similar to FIG. 5 but illustrating the three-dimensional tapering of the stiffening structure main support member ends and periphery to increase flexibility of the structure.

FIG. 2 illustrates the use of the present invention wherein a main body 14 of the bra terminates at its bottom portion in a structure defining sleeve 18 into which stiffening structure 21 is inserted or stitched (18'). The structure may be of nylon, polypropylene, velox or any other material having the same or similar characteristics. These materials are washable, will take permapress, and resist disintegration in temperatures up to 360° F. Furthermore, they have a human feel, will outwear previous known wires and bones, and will in fact last longer than the life of the garment in which they are placed.

Figure 4:
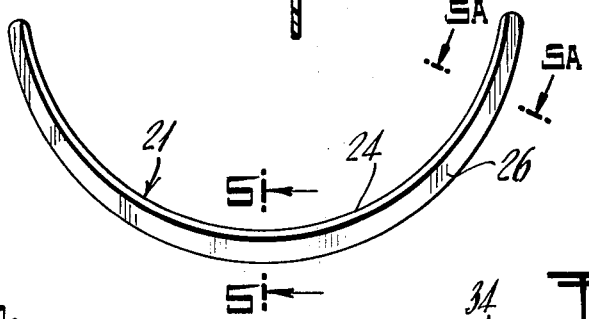
FIG. 4 is a front view of a stiffening structure according to the present invention.

More specifically, FIG. 4 shows stiffening structure 21 as including a main support member 24 to which is appended a similarly crescent shaped flange 26, the shape providing the flexibility and flange 26 particularly providing rigidity to stiffening structure 21.

Figure 3:
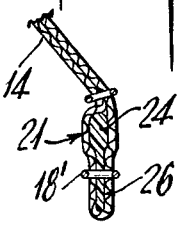
FIG. 3 is a side, partial, sectional view taken along the line of 3—3 of FIG. 2 and showing particularly the stiffening structure of the present invention sewn in place in a bra.
Figure 5:
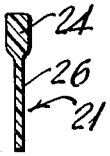
FIG. 5 is a side, sectional view, taken along the line 5—5 of FIG. 4.

FIG. 3 shows the reduced cross-section of flange 26 with respect to main support member 24 and more importantly illustrates the use of sewing thread 18' through flange 26, thus holding stiffening structure 21 in place while defining sleeve 18.

Figure 6:
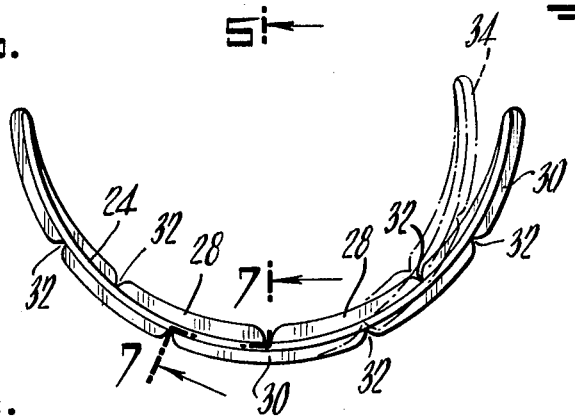
FIG. 6 is a front view of a stiffening structure according to an alternative embodiment of the present invention showing particularly the use of staggered bifurcation in the flanges thereof.
Figure 7:
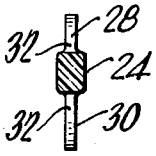
FIG. 7 is a side sectional view taken along the line 7—7 of FIG. 6.
Figure 9:
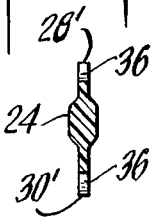
FIG. 9 is a side sectional view taken along the line 9—9 of FIG. 8.
Figure 11:
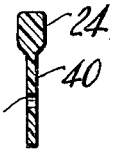
FIG. 11 is a side, sectional view taken along the line 11—11 of FIG. 10.

Another embodiment of the present invention is shown in FIG. 6 wherein main support member 24 is used with two flanges 28, 30 each of which defines repeated bifurcations 32. It may be seen that the bifurcations 32 are staggered along the length of the respective flanges 28, 30, so that the rigidity is maintained while still enabling more flexibility as illustrated by the ghost lines 34 of FIG. 6. The reduced cross-section of flanges 28, 30 is particularly illustrated in FIG. 7 serving to maintain the combination of flexibility and rigidity desired. It is obvious that sewing occurs through flanges 28, 30.

Figure 8:
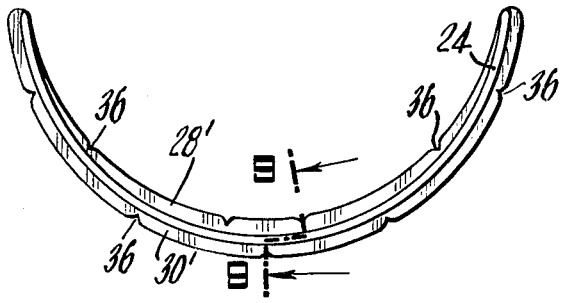
FIG. 8 is a front view of a stiffening according to yet another alternative embodiment of the present invention, showing particularly the use of notched flanges.

FIG. 8 illustrates yet another embodiment of the present invention wherein main support member 24 is appended to two flanges 28', 30', each of which has repeated, staggered notches 36 to increase the rigidity over that of the embodiment of FIG. 6, while still maintaining the needed flexibility.

Figure 10:
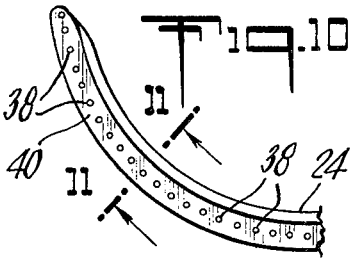
FIG. 10 is a partial, front view of a boning structure according to still another alternative embodiment of the present invention, showing particularly the use of pre-cut sewing holes in the flange thereof.

Another embodiment of the present invention is illustrated in FIG. 10 wherein pre-cut holes 38 are provided in a flange 40 (or in flanges 40, if there be more than one) in order to provide a stiffening structure with a more rigid material and yet which is suitable for use with the present invention in terms of fixing the stiffening structure in place.

In all embodiments, the stiffening structure of the present invention is injection molded and either of a material as recommended above to enable easy perforation by a ball point sewing needle, or of any other suitable material to provide rigidity and flexibility with or without pre-cut sewing holes 38, as shown in the embodiment of FIG. 10. Furthermore, the flanges can be fused directly to the material, if desired. Also, the stiffening structure may be sewn onto the bra without the necessity of sleeve 18.

In all embodiments, the lack of protrusion of the stiffening material, its rigidity and flexibility combine to form a supportive bra structure, which is comfortable for the wearer and yet provides her with a desirable and necessary support. Furthermore, the material is non-allergic and does not present the possibility of physical damage to the wearer.

It is very practical since it is fabricated of a non-allergic material which will hold its original shape throughout the life of the garment. It does not distort the natural shape of a woman, nor does it hurt as the present wires often do. It insures greater comfort while achieving the same effect as the present wire structures. For health reasons, it is an improvement because plastic, nylon or other fabrication of this sort takes on a natural supportive shape for the breasts like a human touch.

Another important point is that the invention is to be molded, and in the mold the stress points, the resins, tolerances, thickness or thinness can be controlled where necessary. Only in this way can this be a tailormade product to suit all figures without injury to the body. Wires cannot be made with any variation within the same structure, whereas the invention can. Also the structure will allow better breathing. The invention features wearability and long-lasting properties in that it conforms to the human shape, allows more comfort, and fabrication of nylon or plastic is acceptable and cannot cause cancer or breast damage. It is a natural uplifting support and breathes with the body. Present wires are hard and cause many problems, discomfort and even pain, and are not accepted by most doctors.

The invention replaces metal or wire currently in use and offers a more natural, human feeling while accomplishing the same support. It also enhances the garment, giving a more natural appearance, so important a part of today's fashion look. Furthermore, the invention cannot cause trouble to the bra cups since plastic will not rip through as does wire, allowing wire reinforcements to poke through to the skin. This new structure will give all the support features and perform the support function while maintaining the beauty shape and fit beyond the life of the garment.

It will save on labor costs, which means savings in manufacturing, since it can be easily sewn directly to the garment—again insuring proper fit, holding the cup with no distortion, thereby making a beautiful garment.

Furthermore, it will save on inventory costs since there will be less rejections based upon the superior means of affixing the invention in the cup.

A much more significant savings on inventory costs will occur because the structure of the present invention requires only one model for each cup size. Therefore, the same A-model stiffening structure may be used in any A-cup bra currently being produced. A different model is only required for a different cup size. A single supplier could supply many different manufacturers from the same single size unit for each cup. The only distinction between the units would be for each different cup size.

The fact that the plastic structure can be joined to the garment by sewing or fusing right onto the bra makes this a very acceptable product to the general female public.

What is claimed is:

1. A stiffening structure for a woman's undergarment, defining a sleeve therein, comprising a main support member having ends and a periphery, said main support member being three-dimensionally tapered with smaller ends and periphery for added flexibility, a pair of flanges appended to said main support member and on opposite sides thereof, said flanges each defining a series of spaced bifurcations for providing additional flexibility for said structure, and said member and said flanges being generally of a crescent shape for providing a support function for a part of the woman's body.

2. The invention according to claim 1 wherein said flange defines pre-cut sewing perforations for affixing said structure into the sleeve of said undergarment.

3. The invention according to claim 1 wherein the bifurcations of one flange are staggered with respect to the bifurcations of the other flange.

4. The invention according to claim 1 wherein the notches of one flange are staggered with respect to the notches of the other flange.

5. The invention according to claim 4 wherein said flanges define pre-cut sewing perforations for affixing said structure into the sleeve of said undergarment.

6. The invention according to claim 1 wherein said flange is unperforated and of a material enabling perforation for sewing purposes by a ball point needle.

7. A stiffening structure for a woman's undergarment, defining a sleeve therein, comprising a main support member having ends and a periphery, said main support member being three-dimensionally tapered with smaller ends and periphery for added flexibility, a pair of flanges appended to said main support member and on opposite sides thereof, said flanges each defining a series of spaced notches for providing additional flexibility, while maintaining rigidity, for said structure, and said member and said flanges being generally of a crescent shape for providing a support function for a part of the woman's body.

* * * * *